US007311653B2

(12) United States Patent
Kusumoto

(10) Patent No.: US 7,311,653 B2
(45) Date of Patent: Dec. 25, 2007

(54) CENTRIFUGAL SEPARATOR HAVING A STRUCTURE FOR FACILITATING OPENING AND CLOSING A DOOR

(75) Inventor: Shoji Kusumoto, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 59 days.

(21) Appl. No.: 11/222,754

(22) Filed: Sep. 12, 2005

(65) Prior Publication Data

US 2006/0058168 A1 Mar. 16, 2006

(30) Foreign Application Priority Data

Sep. 15, 2004 (JP) ..... P2004-268406

(51) Int. Cl.
*B04B 5/02* (2006.01)
*B04B 7/02* (2006.01)

(52) U.S. Cl. ..... 494/16; 494/60

(58) Field of Classification Search ..... 494/5, 494/12, 14, 16–21, 26, 39, 60–61
See application file for complete search history.

(56) References Cited

U.S. PATENT DOCUMENTS

| | | | | | |
|---|---|---|---|---|---|
| 2,745,217 | A * | 5/1956 | Gold et al. | ..... | 99/472 |
| 3,860,166 | A * | 1/1975 | Anderson | ..... | 494/13 |
| 4,226,669 | A * | 10/1980 | Vilardi | ..... | 159/6.1 |
| 5,217,572 | A * | 6/1993 | Guy et al. | ..... | 159/6.1 |
| 5,466,385 | A * | 11/1995 | Rogers et al. | ..... | 210/787 |
| 6,599,229 | B1 * | 7/2003 | South et al. | ..... | 494/26 |
| 2006/0058168 | A1 * | 3/2006 | Kusomoto | ..... | 494/16 |

FOREIGN PATENT DOCUMENTS

| | | | |
|---|---|---|---|
| DE | 2611679 | * | 9/1977 |
| JP | 09-075782 | | 3/1997 |
| JP | 2002-336738 | | 11/2002 |

* cited by examiner

*Primary Examiner*—Charles E. Cooley
(74) *Attorney, Agent, or Firm*—Mattingly, Stanger, Malur & Brundidge, P.C.

(57) ABSTRACT

An air flow valve capable of being opened and closed is provided between the interior of the rotor chamber sealed with the door and the exterior thereof, and formed so that, when the door is closed, or when the door is opened, the air flow valve is temporarily opened.

20 Claims, 6 Drawing Sheets

CENTRIFUGAL SEPARATOR HAVING A STRUCTURE FOR FACILITATING OPENING AND CLOSING A DOOR

BACKGROUND OF THE INVENTION

1. Field of the Invention

The present invention relates to a centrifugal separator, and more particularly to structure for facilitating the opening and closing of a door for sealing a rotor-housed rotor chamber.

2. Description of the Related Art

In a centrifugal separator, a rotor on which a sample to be separated is supported via a tube and a bottle is held in a rotor chamber (rotary chamber), and the rotor is rotated at a high speed by a driving unit, such as a motor with an opening of the rotor chamber closed tightly with a door, the separation and the refining of the sample supported on the rotor being thereby done. The rotational speed of the rotor differs depending upon the use of a separated or refined product. Products having a wide range of rotational frequencies from a comparatively low maximum level of around several thousands (rpm) to a high maximum level of around one hundred and fifty thousands (rpm) are generally provided.

When the rotor of the centrifugal separator is rotated at a high speed in the rotor chamber closed tightly with the door, frictional heat occurs between the rotor and the air existing in the rotor chamber, to cause a windage loss to be brought about, so that the temperature of the rotor increases to an abnormal level. Therefore, many centrifugal separators rotated at a high speed of, for example, not smaller than twenty thousands rpm are mounted with cooling units. On a high-speed or super high-speed centrifugal separator, a vacuum unit for reducing the pressure of the interior of the rotor chamber to a high vacuum or a low vacuum is mounted in addition to the above-mentioned cooling unit. The mounting of the vacuum unit serves as techniques for practicing the more complete prevention of a temperature rise ascribed to the windage loss.

A cooling unit-carrying centrifugal separator is provided with a cooler made of refrigerating pipes extending along an inner circumferential surface of a rotor-holding chamber as shown, for example, in JP-A-2002-336738. This cooler makes the rotor chamber cool, suppresses the generation of heat occurring due to the rotation of the rotor, and thereby controls the rotor temperature to be at not higher than a predetermined level. Therefore, it is demanded in the related art centrifugal separator that the interior of the rotor chamber closed tightly with the door and the outside thereof be thermally shut off from each other, and that the degree of closure of the space (closed chamber) defined by and sealed with wall members of the rotor chamber and door against the outside air is improved.

The rotor chamber is made as a space closed against the outside except the opening portion thereof which is provided with the door used when the rotor and sample are inserted and withdrawn thereinto and therefrom. Furthermore, a packing made of an elastic member is provided between the rotor chamber and door. When the door is closed, the packing is pressed so that the outside air does not enter the rotor chamber, and thus a space closed with the rotor chamber and door is formed. The "closed space" or "sealed space" used in the specification of the present invention means usually a space defined by wall members which permit such a little leakage of a small quantity of the air that does not have influence upon the cooling capacity of the space. Such a space may, of course, be a space thermally shut off from or defined with respect to the outside air more completely by using a vacuum seal.

An example of a centrifugal separator mounted with a vacuum pump for making the interior of a rotor chamber vacuous in order to reduce a windage loss to as great an extent as possible of a high-speed rotated rotor is disclosed in JP-A-9-75782. In the techniques disclosed in JP-A-9-75782, a door is closed so as to seal an opening of the rotor chamber off the outside air, and an air leakage valve for communicating the interior of the rotor chamber and the outside air with each other is then closed to make the rotor chamber highly vacuous. The rotor is rotated in this condition at a high speed. After the operation finishes being carried out, the rotor is taken out from the rotor chamber by opening the air leakage valve by using a special switch to open the rotor chamber into the atmospheric air, and thereafter opening the door. Especially, the characteristics of this centrifugal separator reside in that the switch controlled by both a valve-opening signal and a rotational frequency detecting signal is provided so as to prevent the air leakage valve from being opened inadvertently by an erroneous operation during the rotation of the rotor.

SUMMARY OF THE INVENTION

In the centrifugal separator in which the sealed chamber is formed by the rotor chamber and door, a large force is needed to open and close the door. Especially, the manual door is opened and closed frequently by an operator handling the centrifugal separator, and this causes a decrease in the operation efficiency or work efficiency and the inconvenience of using the centrifugal separator to occur. Although a centrifugal separator having an automatic door opening and closing mechanism utilizing an external power source, such as a motor having a large driving power instead of a manual door opening and closing mechanism has been known, the automatic mechanism for opening and closing the door becomes complicated, and this centrifugal separator became expensive as compared with the centrifugal separator having such a manual door opening and closing mechanism.

The schematic diagram of FIG. 6 shows a calculation expression of a reaction force occurring when the opening and closing of the door are done. When the door supported on one end of the opening of the rotor chamber via a hinge is closed, a pressing margin of the packing is compressed, so that a reaction force F similar to an air spring action shown in FIG. 6 is received with the reaction force from the packing. However, the influence of the reaction force F of this air spring action is gradually lost owing to the leakage of a very small quantity of air occurring after the door is closed.

The door is formed so that the door can usually be opened and closed via hinge. When a scatter of the hinge fixing position, a scatter of the packing manufacturing operation and the like are taken into consideration, it is necessary that a pressing margin of the packing be designed with a certain degree of allowance left so as to heighten the degree of closure and sealing of the rotor chamber. However, forming the pressing margin with allowance left necessarily causes the pressure P1 in the rotor chamber to further increase. As a result, the reaction force F due to the air spring action is further increased. This causes the operator to require a larger force when the door is closed, so that a decrease in the operation efficiency and work efficiency occurred in the manual door.

When the door is opened, the pressure in the rotor chamber decreases contrariwise to the case where the door is closed, and a large force was required in the same manner as in the case where the door is closed. This makes it difficult as well to open the door. However, in this case, the reaction force generated by the packing works in the door-opening direction, so that a decrease in the operation efficiency is lessened as compared with that in the case where the door is closed.

JP-A-9-75782 shows that, before a door is opened after a centrifugal separation operation finishes, in, especially, a centrifugal separator having a highly vacuum rotor chamber, an air leakage valve is opened so as to open the highly vacuum rotor chamber into the outside air. In order to open and close the air leakage valve, a special switch is needed. The switch for opening and closing the air leakage valve is formed so that the switch is operated irrespective of the opening and closing of the door. Therefore, the door operating efficiency and the convenience of using the door are low. In a centrifugal separator having a cooling unit in a rotor chamber, an air leakage valve is left as it is after the door is opened, so that dew drops readily occur in an air flow passage communicating with the air leakage valve.

Therefore, a primary object of the present invention is to provide a centrifugal separator having improved operation efficiency or work efficiency by forming a door for sealing an opening of a rotor chamber so that the door can be opened and closed by a small force.

Another object of the present invention is to provide a door opening and closing mechanism suitable for a centrifugal separator provided with a cooling unit for making a rotor chamber cool, and adapted to open and close the door manually.

These and other objects of the present invention as well as the novel features thereof will become more apparent from the following description in the specification and the accompanying drawings.

In order to solve the above problems, the inventor of the present invention paid his attention to the elimination of the influence of an air spring effect, which is ascribed to the above-mentioned pressure variation, upon the opening and closing of the door with respect to the opening of the rotor chamber. The present invention has the features of providing an air flow passage, which permits the air to freely flow between the interior and exterior of the rotor chamber closed with the door, in such a manner that the pressure in the sealed chamber defined by the rotor chamber and door does not fluctuate with respect to the atmospheric pressure outside the sealed chamber when the door is in a transient state in which the door is opened and closed. This air flow passage is kept closed so as not to lower the cooling capacity of the interior of the rotor chamber during a steady condition in which the rotor is rotated.

Out of the inventions according to the present invention, the outlines of typical inventions will now be described as follows.

(1) The centrifugal separator according to the present invention includes a driving unit, a rotor rotated by the driving unit and holding a sample to be separated, a rotor chamber holding the rotor therein and having an opening on an upper side thereof, and a door adapted to seal the opening of the rotor chamber off the outside air and provided so that the door can be opened and closed freely, wherein an air flow valve provided between the interior and exterior of the rotor chamber sealed with the door, and formed so that the air flow valve can be opened and closed, the air flow valve being opened when closing or opening the door.

(2) A centrifugal separator according to (1) above, wherein the air flow valve becomes opened when the door is closed and when the door is opened, and becomes closed in other state, i.e., in a steady state.

(3) A centrifugal separator according to (2) above, wherein the door has a door lever for opening and closing the door, and is formed so that the air flow valve becomes opened when the door is closed and opened in accordance with an operation of the door lever and so that the air flow valve becomes closed in other state, i.e., in a steady state.

(4) A centrifugal separator according to (1) above, wherein the air flow valve is a check valve adapted to make the air to flow from the interior of the rotor chamber to the exterior thereof when the door is closed.

(5) A centrifugal separator according to (1) to (4) above, wherein the air flow valve is provided in the door.

(6) A centrifugal separator according to (1) to (5) above, wherein the air flow valve is provided in the portion of the door which an extension of the axis of rotation of the rotor crosses or partition member of the rotor chamber.

(7) A centrifugal separator according to (1) to (6) above, wherein the centrifugal separator is further provided with a cooling unit used to cool the rotor.

In the centrifugal separator according to the present invention, the air flow valve communicates the rotor chamber sealed with the door and the exterior (outside air) of the rotor chamber with each other, so that the pressure in the rotor chamber can be set equal to the atmospheric air pressure. As a result, the door can be opened and closed by a small force without receiving the influence of a reaction force occurring due to the sealed rotor chamber.

In the centrifugal separator according to the present invention, the air flow valve communicates the rotor chamber, which is sealed in accordance with the opening and closing of the door, and the outside air of the rotor chamber with each other, so that the pressure in the rotor chamber can be set equal to the atmospheric air. As a result, the operation efficiency or work efficiency of the centrifugal separator can be improved.

In the centrifugal separator according to the present invention, the pressing force necessary for the door opening and closing mechanism can be saved, so that a manual door opening and closing structure of a high operation efficiency can be provided. An inexpensive centrifugal separator as compared with a centrifugal separator having an automatic complicated door opening and closing mechanism can also be provided.

DETAILED DESCRIPTION OF THE PREFFERED EMBODIMENTS

Figure 1:
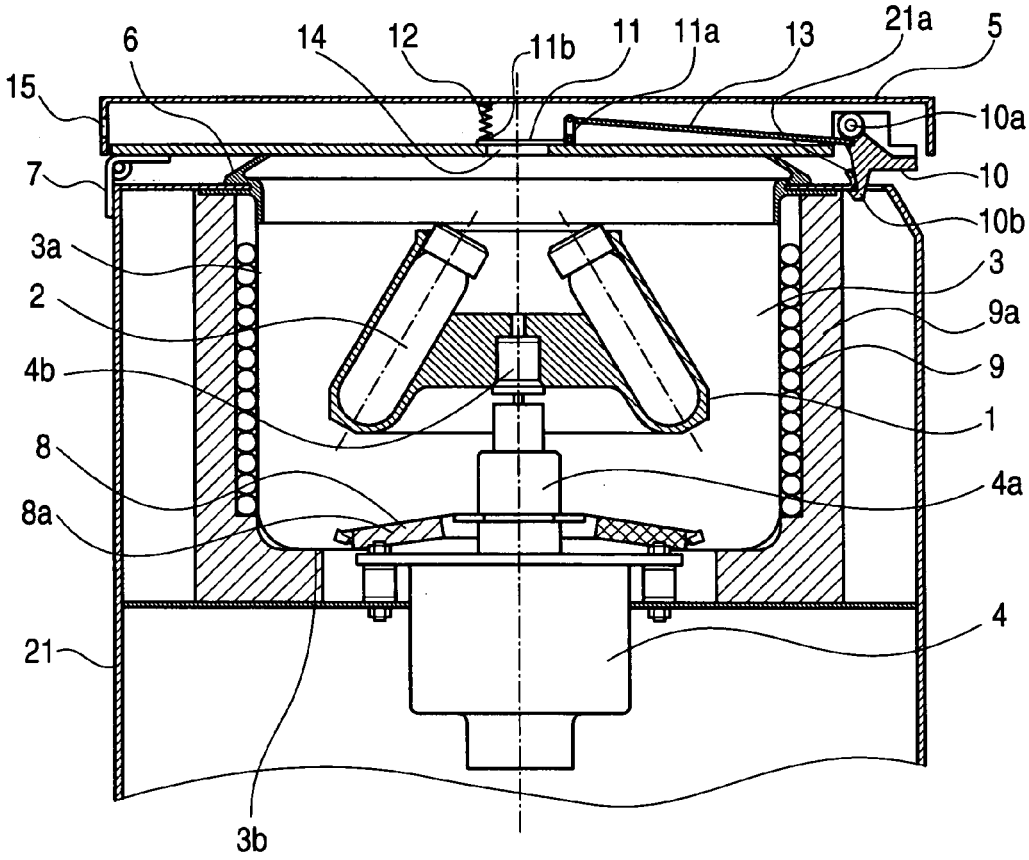
FIG. 1 is a sectional view of a principal portion of the centrifugal separator in a first mode of embodiment of the present invention in a steady state after the closure of a door.

The modes of embodiments of the present invention will now be described in detail on the basis of the drawings. In all the drawings for describing the modes of embodiments, the same reference numerals are added to the members having the same functions, and repeated descriptions of the members will be omitted.

Figure 2:
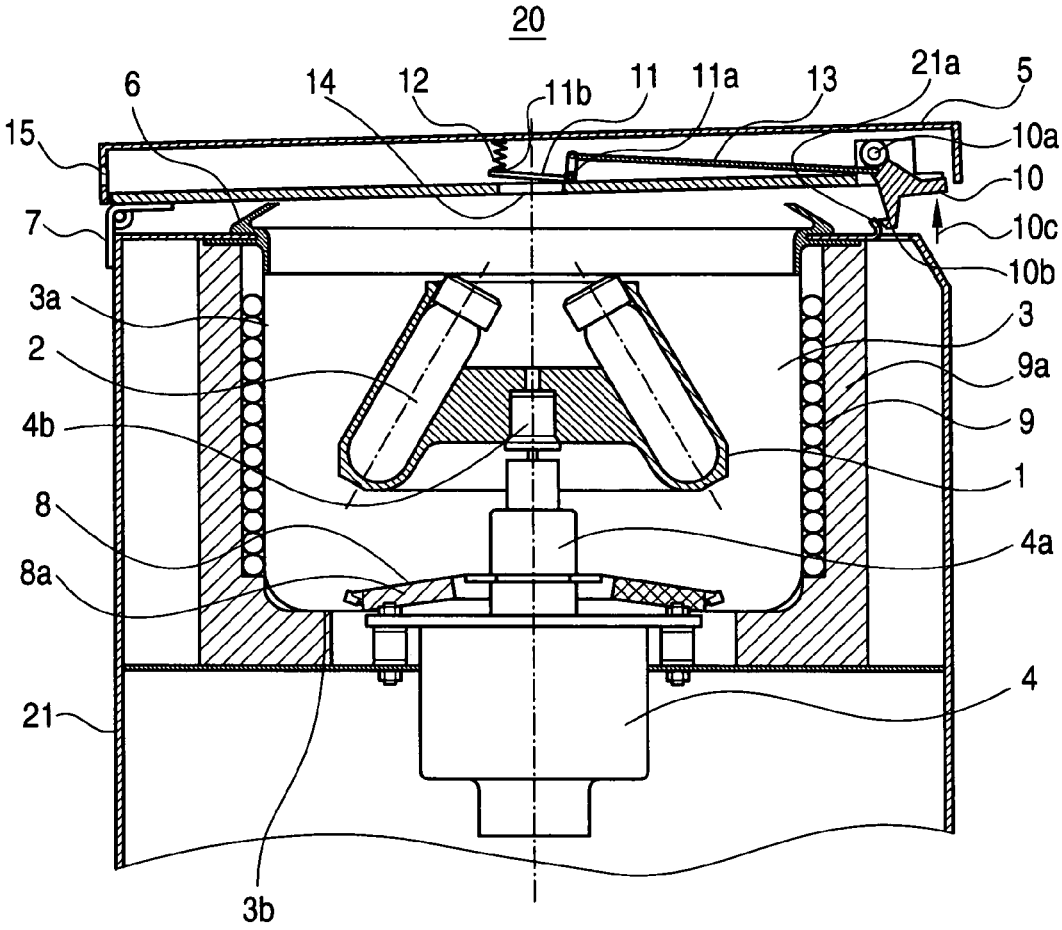
FIG. 2 is a sectional view of a principal portion of the centrifugal separator in the first mode of embodiment of the present invention in a transient state in which the door is being closed.
Figure 3:
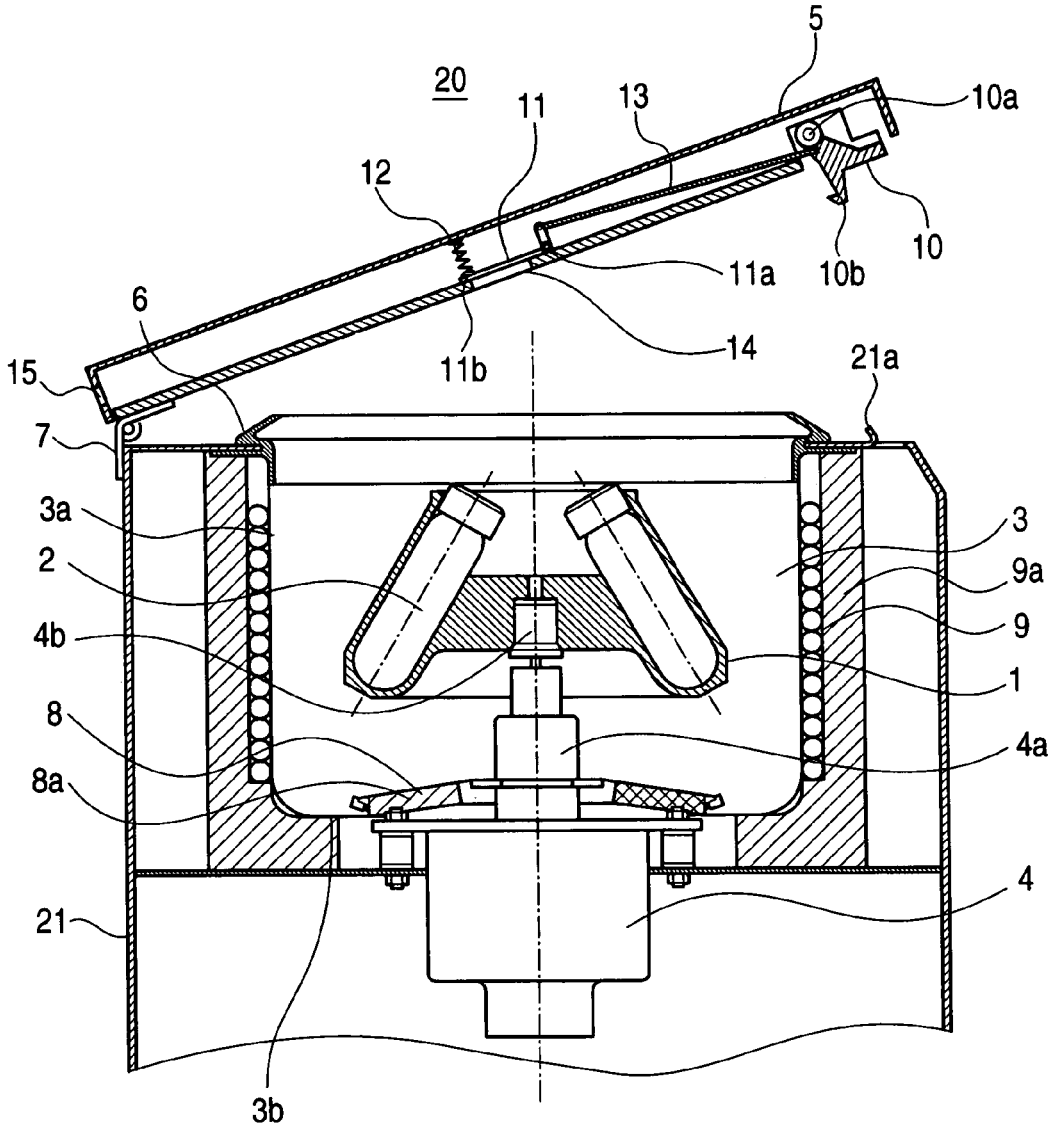
FIG. 3 is a sectional view of a principal portion of the centrifugal separator in the first mode of embodiment of the present invention in the steady state after the opening of the door.

FIGS. 1 to 3 are sectional views (side views) of a principal portion of the centrifugal separator in a first mode of embodiment of the present invention, wherein FIG. 1 is a sectional view in a steady state after the closure of the rotor chamber opening and closing door; FIG. 2 a sectional view of the same in a transient state in which the door is being closed; and FIG. 3 a sectional view of the same in a steady state after the opening of the door.

Referring to FIG. 1, a centrifugal separator 20 is provided with a case (frame) 21 having a square horizontal sectional view. The case 21 is provided therein with a sample container 2 assembled therein and containing a sample, such as blood to be centrifugally separated, a rotor holding the sample container 2 therein and giving a high-speed rotation thereto, a driving unit 4 having a motor and the like therein for giving a driving force to the rotor 1 via a rotary shaft 4*b*, and a rotor chamber (rotary chamber) 3 housing the rotor 1. The centrifugal separator is further provided with a door 5 for sealing an upper opening of the rotor chamber 3 formed in the interior of the case 21.

The rotor chamber 3 is formed by a bowl-shaped partition member including a side wall portion 3*a* and a bottom portion 3*b*. On an outer circumference of the side wall 3*a*, a helical refrigerating pipe (9) is provided, which is formed so that the interior of the rotor chamber 3 is cooled. This structure cools the rotor 1 in a rotational movement, and prevents a temperature rise thereof. In order to prevent a decrease in the efficiency of cooling the rotor chamber 3 from occurring in the rotor chamber 3, the refrigerating pipe 9 is provided on the outer circumference thereof with a heat insulating layer 9*a* made of a heat insulating material.

In order to further improve the efficiency of cooling the rotor chamber 3, a bottom opening of the rotor chamber 3, from which the housing 4*a* of the driving unit 4 projects inward, is sealed with seal rubber 8 made of an elastic material, such as rubber fixed on a base member 8*a* made a heat insulating material. In the meantime, the upper opening of the rotor chamber 3 out of and from which the rotor 1 and sample container 2 and the like are taken and inserted is provided with a door packing 6 made of an elastic material, such as rubber, the upper opening being sealed by crushing the packing 6 by the door 5.

Figure 6:
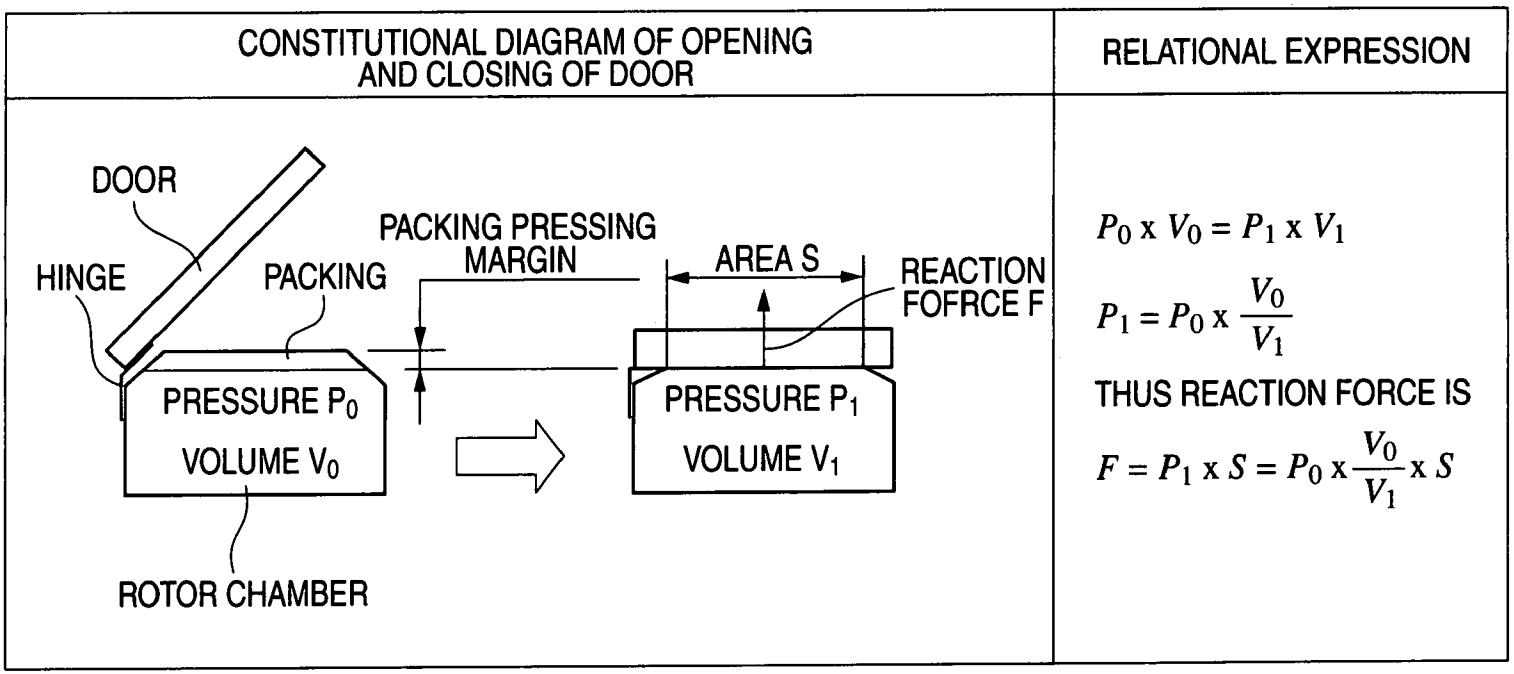
FIG. 6 is a calculation expression of a reaction force occurring due to an air spring effect at the time of the closure of the door of a centrifugal separator.

The upper opening of the rotor chamber 3 is thus sealed with the door 5, while the bottom opening of the rotor chamber 3 is sealed with the seal rubber 8. Therefore, in the related techniques for the centrifugal separator, the operator necessarily receives when he closes the door 5 and crushes the door packing 6 by the door 5 a reaction force of the door packing 6 and a reaction force due to the air spring effect ascribed to an increase in the pressure in the rotor chamber 3 as shown in FIG. 6. In order to open the door 5, the pressure in the rotor chamber 3 decreases conversely, so that the door is set difficult to be opened.

According to the present invention, an air flow valve (which will hereinafter be referred simply as "air flow valve") having the following switch valve is provided between the interior and exterior of the rotor chamber 3 closed with the door 5 is provided so as to prevent the influence of the reaction force at the time of opening and closing of the door. The air flow valve is formed so that this valve is opened when the door 5 is closed or opened.

As shown in FIG. 1, the door 5 is provided in a front side wall (right side in the drawing) thereof with a door lever 10 which can be turned around a pin 10*a* as a shaft. The door 5 is provided at a central portion of a lower wall thereof, i.e. at the portion of the same lower wall which is on an extension of the axis of rotation of the rotor 1, or in the position in the vicinity thereof with a first opening 14, and at a rear side wall portion of the door 5 with a second opening 5. As a result, an air flow passage extending from the rotor chamber 3 to the exterior (outside air) of the rotor chamber 3 via the first opening 14 and second opening 15 is formed. This air flow passage is provided therein with a switch valve 11 (which will hereinafter be referred to as an air flow valve). One end 11*a* of the air flow valve 11 is supported pivotably on the door 5, and the other end 11*b* thereof presses the opening 14 constantly by the spring 12, i.e., the opening 14 being urged so that the opening 14 is sealed. The air flow valve 11 connected by the door lever 10 and a link rod 13, and formed so that the same valve 11 is operatively connected to the door lever 10.

FIG. 2 shows the operational condition of the air flow valve 11 with the door lever 10 gripped by the hand (not shown) to close the door 5. When the door lever 10 is pressed up (in the direction of an arrow 10*c*) by the hand, the link rod 13 is drawn during a transient condition in which the door lever 10 is pressed, to cause the air flow valve 11 to be put in an opened condition. In this condition, a claw portion 10*b* of the door lever 10 is engaged with a hook portion 21*a* provided on the case 21 to close the door 5. In a steady state after the closure of the door, the valve 11 seals the opening 14 by the urging pressure of the spring 12 as shown in FIG. 1. In this steady state, the claw portion 10*b* of the door lever 10 is engaged with the hook portion 21*a*, and the sealed condition of the rotor chamber 3 is thereby maintained.

In the transient state in which the door 5 is being closed, the valve 11 provided in the opening 14 is opened, and the rotor chamber 3 communicates with the outside air through the opening 14 and opening 15. As a result, the pressure in the rotor chamber 3 becomes equal to the external pressure (atmospheric pressure) of the centrifugal separator even when the door 5 crushes the door packing 6. Therefore, the reaction force due to the air spring action does not occur, and the door 5 can be closed easily with a small force.

The door 5 is not opened unless the door lever 10 is operated upward by the hand in the same manner as shown in FIG. 2, so that the air flow valve 10 operatively connected to the door lever 10 is in an opened state. As a result, the pressure in the rotor chamber 3 does not differ from the outside pressure (atmospheric pressure) in the same manner as in the case where the door 5 is closed, so that the inner pressure does not receive a reaction force ascribed to the air spring action. Namely, it is also easy to open the door 5. In the steady state after the opening of the door 5, the valve 11 is not opened unless the door lever 10 is not operated.

Since the door 5 directly contacts the rotor chamber 3, the door 5 is exposed to the cool air in some cases while the rotor 1 is rotated. Therefore, especially, the rear surface side, which is positioned on the side of the rotor chamber 3, of the door 5 is cooled in the same manner as the rotor 1. The dew drops easily occur on the cooled portion since the temperature of the cooled portion is lower than that of the surrounding portion when the door 5 is opened as shown in FIG. 3. When the opening 14 and opening 15 are opened in such condition, dew drops occur even in the interior of the door 5. As a result, inconveniences occur, i.e., the metal in the interior of the door 5 is corroded, or the water collected in the interior of the door 5 is discharged from the rear opening 15 of the door when the door 5 is opened. In order to prevent the occurrence of such inconveniences, the air flow valve 11 is preferably formed so that the same valve be opened only when the pressure in the interior of the rotor chamber 3 is set equal to the external pressure in a transient state in which the door 5 is opened and closed.

Figure 4:
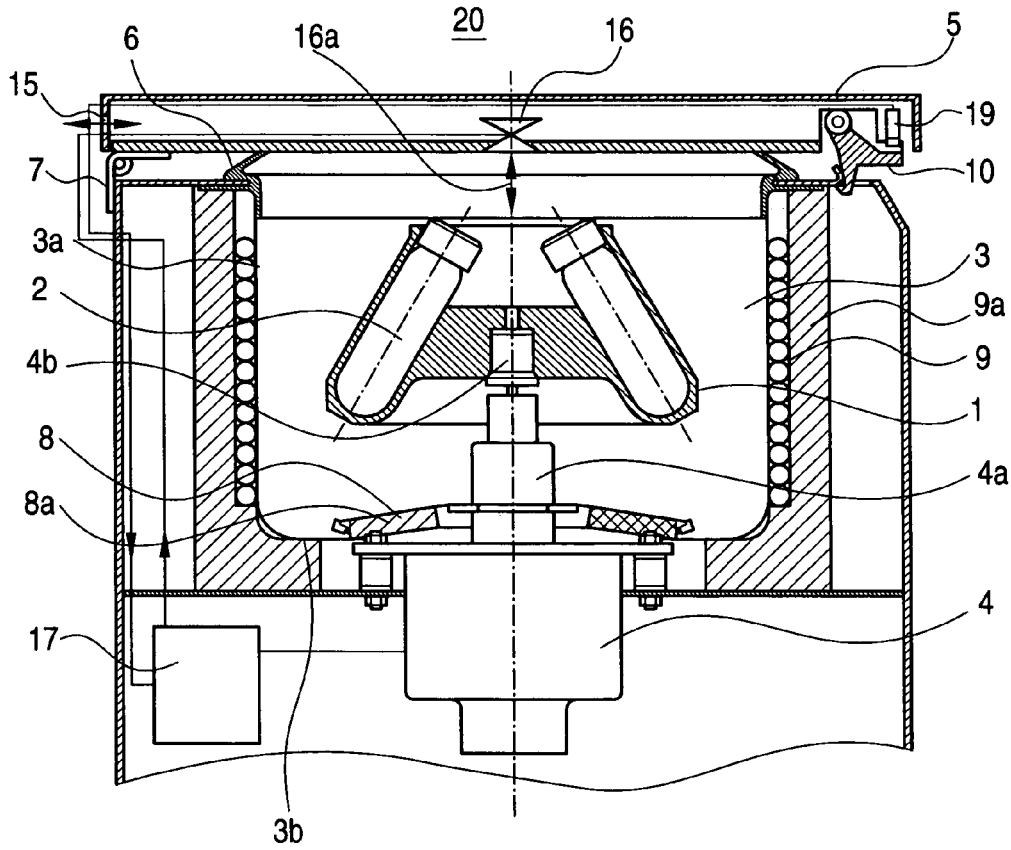
FIG. 4 is a sectional view of a principal portion of the centrifugal separator in a second mode of embodiment of the present invention.

A second mode of embodiment of the present invention will now be described with reference to FIG. 4. In the second mode of embodiment shown in FIG. 4, an electromagnetic valve 16 is used as an air flow valve. The electromagnetic valve 16 detects during an operation for opening or closing a door 5 a movement of a door lever 10 by a detecting element 19, such as a microswitch in a transient condition in which a door 5 contacts a door packing 6, and sends a signal detected to a control circuit 17. The controlling of the electromagnetic valve 16 is done so that the electromagnetic valve 16 is opened in the transient condition only. This system using the electromagnetic valve carries out an action identical with that of the above-described first mode of embodiment, so that the same effect as described above can be obtained. The signal detecting the opening and closing of the door 5 may also be obtained by detecting the inclination of the door by an inclination sensor fixed to the door 5.

Figure 5:
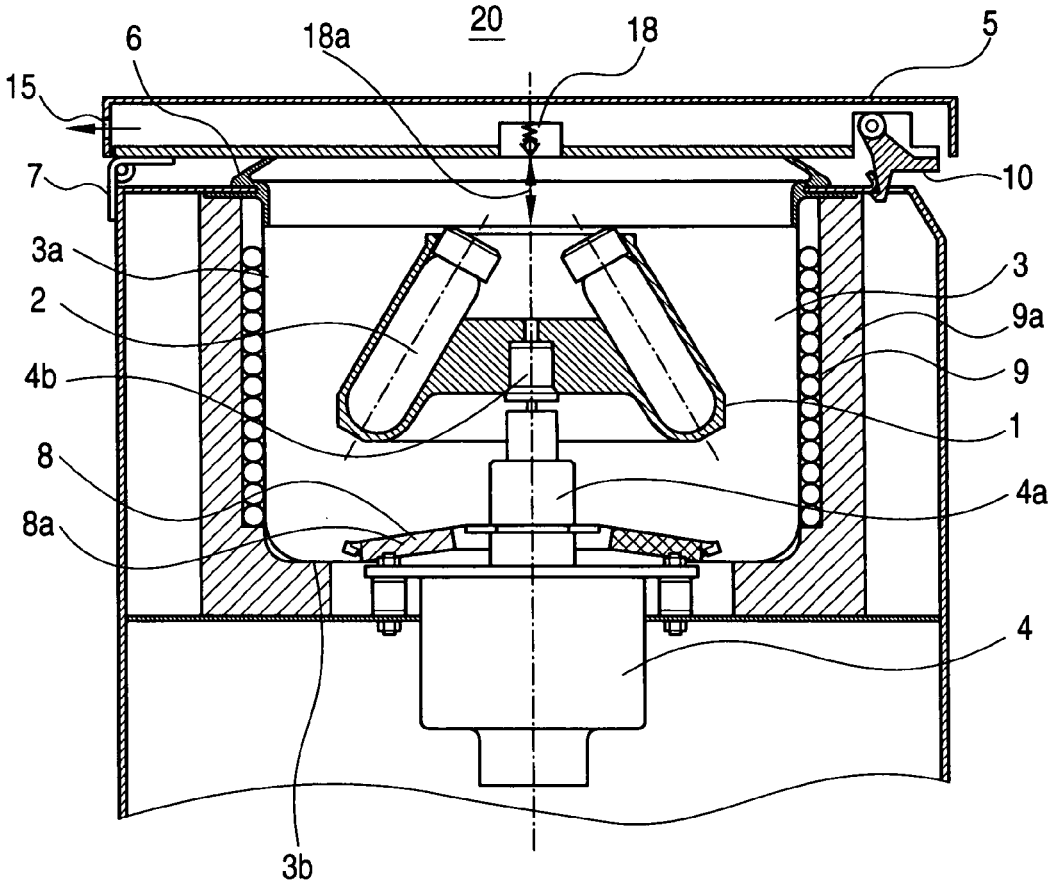
FIG. 5 is a sectional view of a principal portion of the centrifugal separator in a third mode of embodiment of the present invention.

Furthermore, a third mode of embodiment of the present invention uses a check valve 18 as an air flow valve as shown in FIG. 5. The check valve 18 is provided so that the air flows in the direction of an arrow 18*a*. As a result, when the door 5 is closed in the system using the check valve 18 with the inner pressure in the rotor chamber 3 becoming high, the air is exhausted to the outside, so that the force imparted to the door 5*e* can be lessened. However, when the door 5 is opened in this mode of embodiment, the check valve 18 is not opened, so that the pressure in the rotor chamber 3 cannot be reduced. Therefore, after the operation of the centrifugal separator 20 finishes, the door 5 has to be opened by a force the level of which is equal to that of the force by which the door in a regular centrifugal separator is opened. Therefore, the convenience of using the centrifugal separator 20 is improved.

In the above-described modes of embodiments, the various types of air flow valves are provided at the central portion of the door 5 but, basically, the air flow valves may be provided in any portion of the partition members 3*a*, 3*b* of the door 5 and rotor chamber 3. However, when the rotor 1 is rotated, the wind pressure due to the rotation of the rotor becomes high in the portion of the door 5 which is far from the center of rotation of the rotor 1. Therefore, it is preferable that the air flow valve be in the position on the axis of rotation of the rotor 1 in which the influence of the wind pressure is rarely received.

As is clear from the above description, the centrifugal separator according to the present invention is capable of setting the pressure in the rotor chamber equal to the atmospheric air in the transient condition in which the door is opened and closed, since the rotor chamber sealed with the door through the air flow valve and the outside (outside air) are communicated with each other. This enables the door to be opened and closed by a small force without receiving the influence of the sealed chamber. Therefore, since the pressing force needed for the door opening and closing mechanism can be saved, so that a manual opening and closing mechanism having a high operation efficiency can be provided.

The invention made by the inventor of the present invention has been described on the basis of the modes of embodiments thereof. The present invention is not limited to the above-described mode of embodiments, and various modifications within the scope not departing from the gist of the invention can be made.

What is claimed is:

1. A centrifugal separator having a driving unit, a rotor adapted to be rotated by the driving unit and retain a sample to be separated, a rotor chamber holding the rotor therein and having an opening on an upper side thereof, and a door adapted to seal up the opening of the rotor chamber against the outside air and provided so that the door can be opened and closed, wherein an air flow valve capable of being opened and closed is provided between an inner portion and an outer portion of the rotor chamber sealed with the door, and, wherein the door has a door lever for opening and closing the door, the air flow valve being formed so that the air flow valve is rendered opened when the door is closed and opened in accordance with an operation of the door lever, and rendered closed when the door is in a steady condition.

2. The centrifugal separator according to claim 1, wherein the air flow valve is adapted to make the air flow from the inside to the outside of the rotor chamber when closing the door.

3. A centrifugal separator having a driving unit, a rotor adapted to be rotated by the driving unit and retain a sample to be separated, a rotor chamber holding the rotor therein and having an opening on an upper side thereof, and a door adapted to seal up the opening of the rotor chamber against the outside air and provided so that the door can be opened and closed, wherein an air flow valve capable of being opened and closed is provided between an inner portion and an outer portion of the rotor chamber sealed with the door, and wherein the air flow valve is provided in the door and is formed so that the air flow valve is opened when closing or opening the door.

4. The centrifugal separator according to claim 3, wherein the air flow valve is adapted to make the air flow from the inside to the outside of the rotor chamber when closing the door.

5. The centrifugal separator according to claim 3, further comprising a door latching mechanism that, when operated to latch/unlatch the door, opens the air flow valve.

6. A centrifugal separator having a driving unit, a rotor adapted to be rotated by the driving unit and retain a sample to be separated, a rotor chamber holding the rotor therein and having an opening on an upper side thereof, and a door adapted to seal up the opening of the rotor chamber against the outside air and provided so that the door can be opened and closed, wherein an air flow valve capable of being opened and closed is provided between an inner portion and an outer portion of the rotor chamber sealed with the door, the air flow valve being formed so that the air flow valve is opened when closing or opening the door, and wherein the air flow valve is provided in the portion of the door which an extension of an axis of rotation of the rotor crosses or a partition member of the rotor chamber.

7. The centrifugal separator according to claim 6, wherein the air flow valve is adapted to make the air flow from the inside to the outside of the rotor chamber when closing the door.

8. The centrifugal separator according to claim 6, further comprising a door latching mechanism that, when operated to latch/unlatch the door, opens the air flow valve.

9. A centrifugal separator having a structure for facilitating opening and closing a door, which comprises:

a rotor for holding a sample container;

a rotor chamber housing the rotor and having a side wall portion and a bottom portion, a door adapted to seal up an opening of an upper side of the rotor chamber, said door having an air passage communicating between an inside and an outside of the rotor chamber;

a driving unit for rotating the rotor in the rotor chamber; and an air flow valve formed to temporarily open the air passage when closing or opening the door.

10. The centrifugal separator according to claim 9, wherein the air flow valve is a check valve adapted to make the air flow from the inside to the outside of the rotor chamber when closing the door.

11. The centrifugal separator according to claim 9, wherein a cooling unit is disposed to extend along an inner circumferential surface of the rotor chamber for cooling the rotor.

12. The centrifugal separator according to claim 9, further comprising a door latching mechanism that, when operated to latch/unlatch the door, opens the air flow valve.

13. A centrifugal separator having a structure for facilitating opening and closing a door, comprising:

a rotor for holding a sample container;

a rotor chamber housing the rotor and having a side wall portion and a bottom portion, a door adapted to seal up an opening of an upper side of the rotor chamber, said door having an air passage communicating between an inside and an outside of the rotor chamber;

an air flow valve pivotably supported on the door and constantly pressed by a spring to close the air passage; and a door lever operably connected to the air flow valve to open the air passage when the door is closed and opened in accordance with an operation of the door lever.

14. The centrifugal separator according to claim 13, wherein the air flow valve is adapted to make the air flow from the inside to the outside of the rotor chamber when closing the door.

15. A centrifugal separator having a structure for facilitating opening and closing a door, comprising:

a rotor for holding a sample container;

a rotor chamber housing the rotor and having a side wall portion and a bottom portion, a door adapted to seal up an opening of an upper side of the rotor chamber, said door having an air passage communicating between an inside and an outside of the rotor chamber;

an electromagnetic valve disposed to control an air flow of the air passage; and a detecting element which detects an opening of the door and controls the electromagnetic valve to open the air passage when the door is opened.

16. The centrifugal separator according to claim 15, wherein the electromagnetic valve is adapted to make the air flow from the inside to the outside of the rotor chamber when closing the door.

17. The centrifugal separator according to claim 15, further comprising a door latching mechanism that, when operated to latch/unlatch the door, opens the electromagnetic valve.

18. A centrifugal separator having a structure for facilitating opening and closing a door, comprising:

a rotor for holding a sample container;

a rotor chamber housing the rotor and having a side wall portion and a bottom portion, a door adapted to seal up an opening of an upper side of the rotor chamber, said door having an air passage communicating between an inside and an outside of the rotor chamber; and a check valve disposed to control an air flow of the air passage, wherein the air passage is opened by the check valve when the door is closed, and the air passage is closed by the check valve when the door is opened.

19. The centrifugal separator according to claim 18, wherein the check valve is adapted to make the air flow from the inside to the outside of the rotor chamber when closing the door.

20. The centrifugal separator according to claim 18, further comprising a door latching mechanism that, when operated to latch/unlatch the door, opens the check valve.

* * * * *